US006097340A

United States Patent [19]

Chang

[11] Patent Number: 6,097,340

[45] Date of Patent: Aug. 1, 2000

[54] ANTENNA WITH RF ENERGY SHIELD FOR A PORTABLE CELLULAR TELEPHONE

[75] Inventor: Daniel Chang, Pa-Te, Taiwan

[73] Assignee: Auden Technology Mfg. Co., Ltd., Tao-Yuan Hsien, Taiwan

[21] Appl. No.: 09/064,653

[22] Filed: Apr. 22, 1998

[51] Int. Cl.[7] ..... H01Q 1/24

[52] U.S. Cl. ..... 343/702; 343/841

[58] Field of Search ..... 343/841, 702, 343/900, 901, 895; H01Q 1/24

[56] References Cited

U.S. PATENT DOCUMENTS 5,373,304 12/1994 Nolan et al. ..... 343/841
5,526,005 6/1996 Koo ..... 343/841

*Primary Examiner*—Michael C. Wimer
*Attorney, Agent, or Firm*—Pro-Techtor International Services

[57] ABSTRACT

An antenna having a core holding a winding assembly on the inside for receiving/transmitting radio signal, and a resin shell molded on the core, wherein a metal shield is embedded in the resin shell and covered on one half of the periphery of the core to limit the direction of radiation of the radio frequency energy from the winding assembly, and to prevent the radiation from hurting the user's brain.

5 Claims, 10 Drawing Sheets

FIG. 11
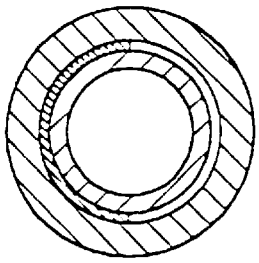
3–3
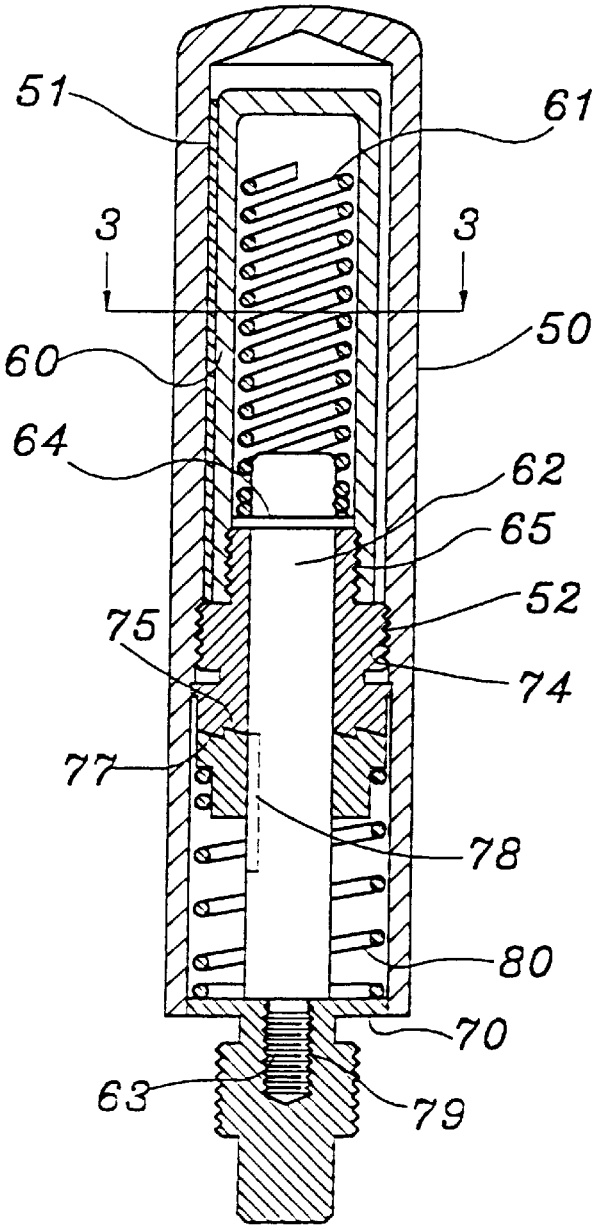
FIG. 10

FIG. 13
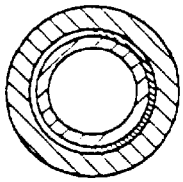
5–5
FIG. 15
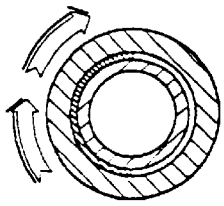
7–7
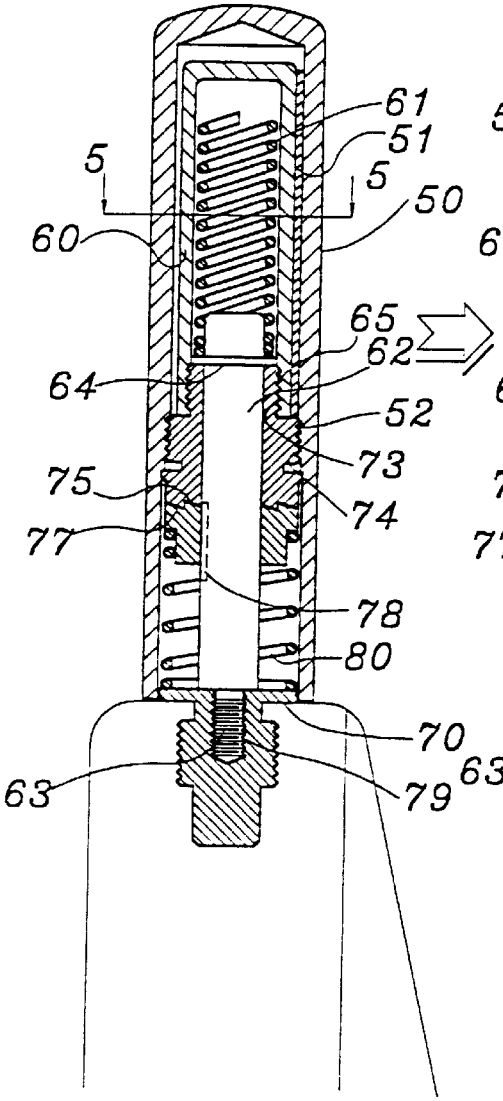
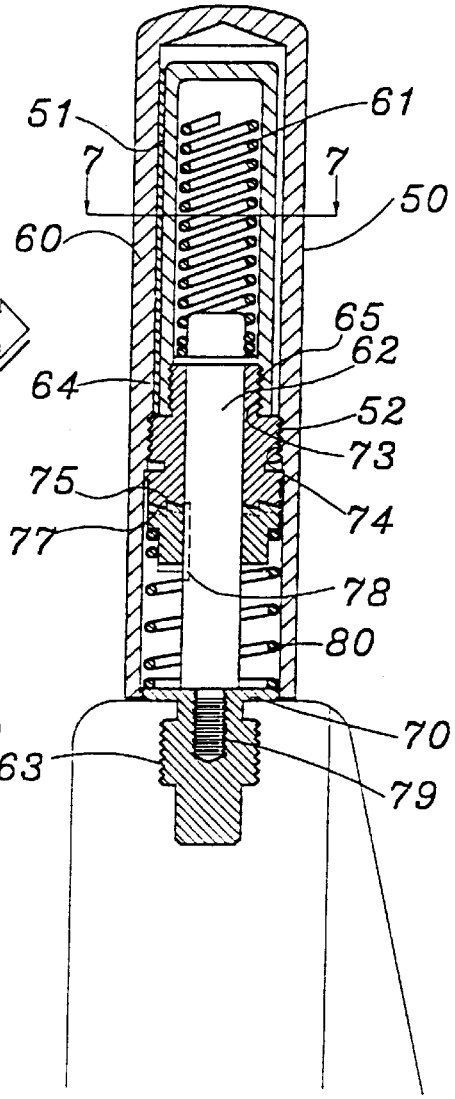
FIG. 12
FIG. 14

ANTENNA WITH RF ENERGY SHIELD FOR A PORTABLE CELLULAR TELEPHONE

BACKGROUND OF THE INVENTION

The present invention relates to an antenna for a portable cellular telephone, and more particularly to such an antenna which has shield means that limits the direction of radiation of the RF energy, preventing it from hurting the user's brain.

A portable cellular telephone uses a radio frequency energy to turn on a telephone and a switching network. The penetration of the radio frequency energy is weak to metal or building. As illustrated in FIG. 1, the frequency of the antenna 11 of the GSM system portable cellular telephone 10 is 0.930 GHZ, and the polarity curve 12 of the radio frequency energy of the antenna 11 is irregular. When the portable cellular telephone is closely attached to the ear during communication, the radio frequency energy is directly radiated from the antenna in direction toward the user's head. Therefore, the antenna must be kept away from the head at a distance when using the portable cellular telephone. However, keeping the antenna from the head at a distance affects the function of the portable cellular telephone.

SUMMARY OF THE INVENTION

The present invention has been accomplished under the circumstances in view. An antenna in accordance with one embodiment of the present invention comprises a metal shield embedded in the resin shell and covered on one half of the periphery of the antenna core. The metal shield limits the direction of the radiation of the radio frequency energy, allowing the user to closely attach the portable cellular telephone to the ear without casing a direct contact of the radio frequency energy with the brain. In an alternate form of the present invention, which is screw mounting design for mounting on a portable cellular telephone by a screw joint, the metal shield can be rotated with the core and the resin shell on a mounting member which is fixedly fastened to the portable cellular telephone.

BRIEF DESCRIPTION OF THE DRAWINGS

FIG. 10 is a sectional view of FIG. 9.

FIG. 11 is a sectional view taken along line 3—3 of FIG. 10.

FIG. 12 is a sectional view showing a state of the present invention where the angular position of the shield is not yet adjusted.

FIG. 13 is a sectional view taken along line 5—5 of FIG. 12.

FIG. 14 is a sectional view showing a state of the present invention where the angular position of the shield adjusted.

FIG. 15 is a sectional view taken along line 7—7 of FIG. 14.

DETAILED DESCRIPTION OF THE PREFERRED EMBODIMENT

Figure 1:
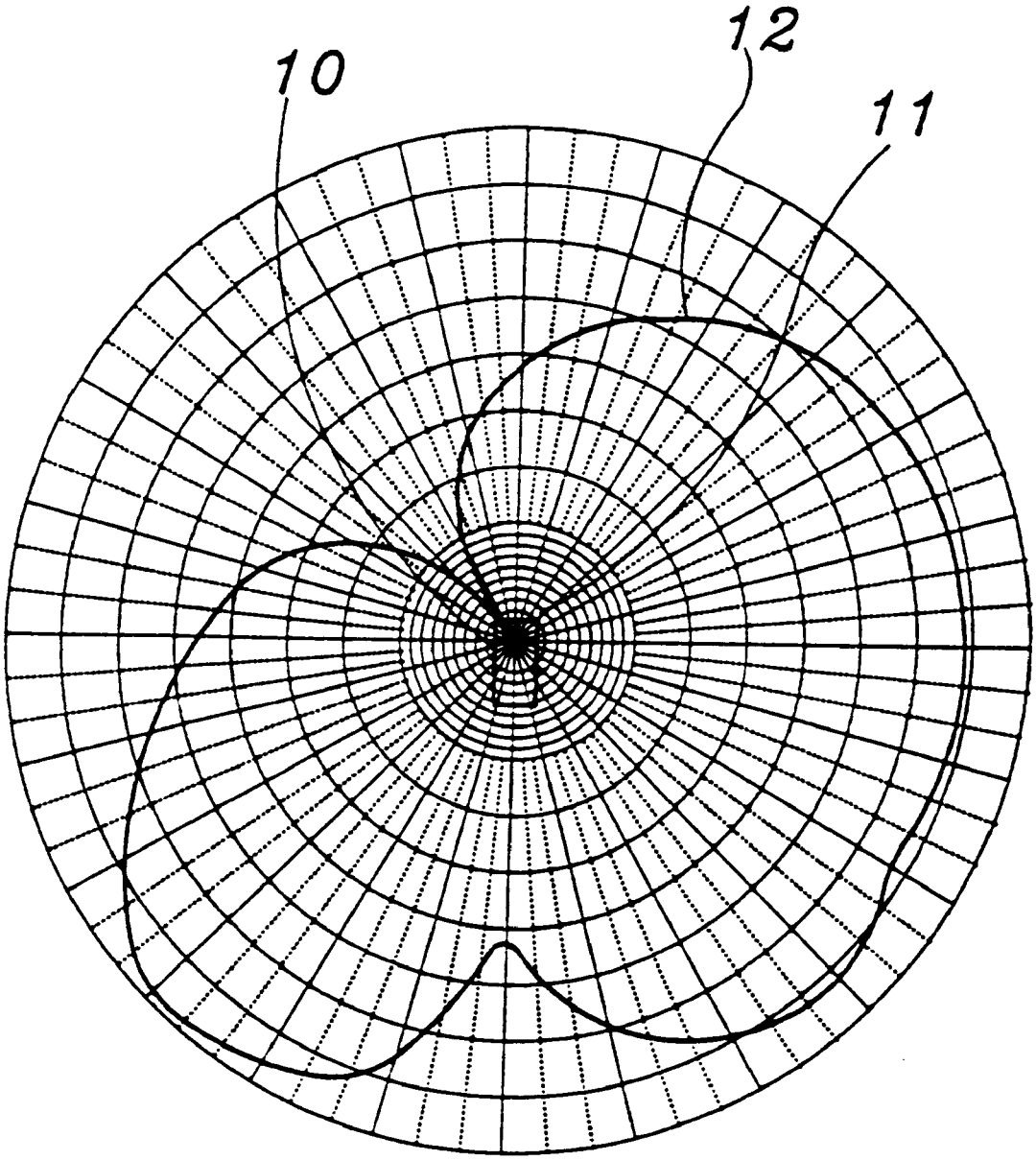
FIG. 1 shows the radiation of radio frequency energy of a portable cellular telephone according to the prior art.
Figure 2:
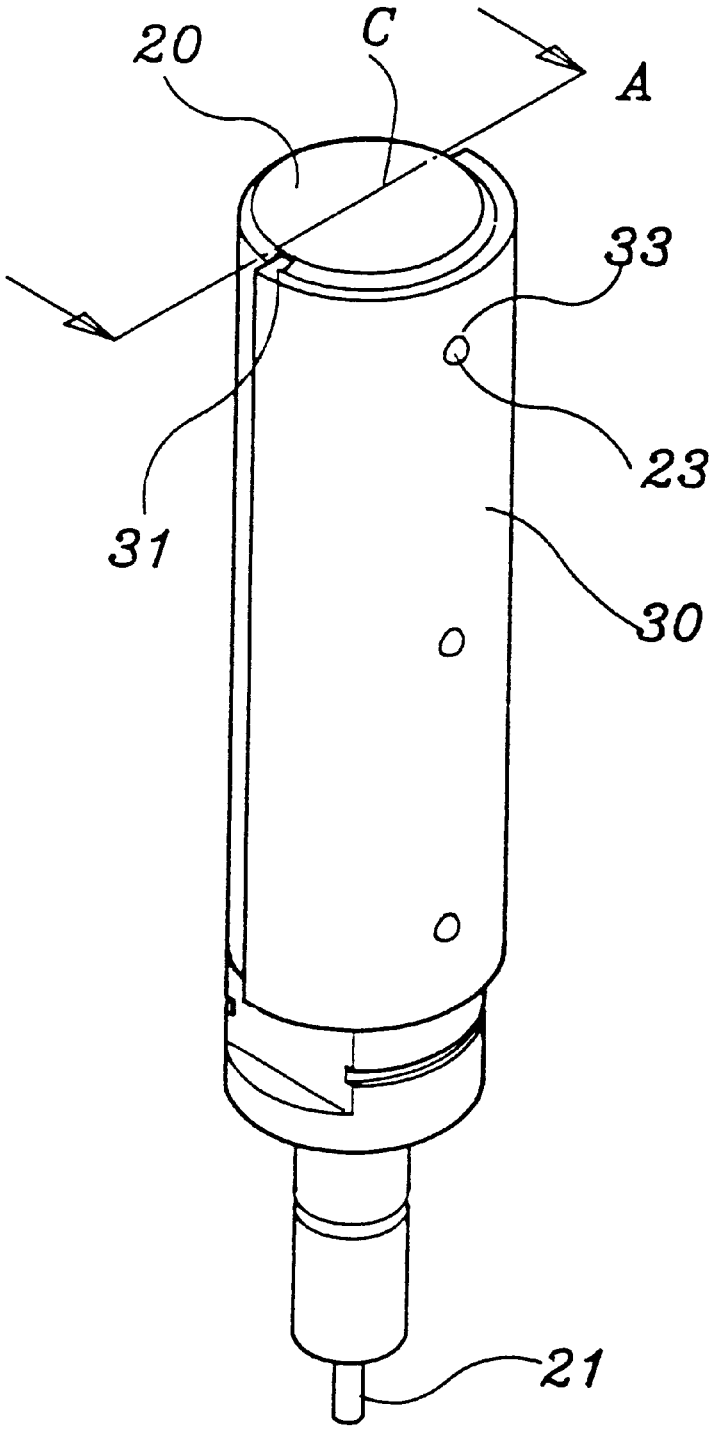
FIG. 2 illustrates a metal shield covered on the periphery of an antenna core according to the present invention.
Figure 3:
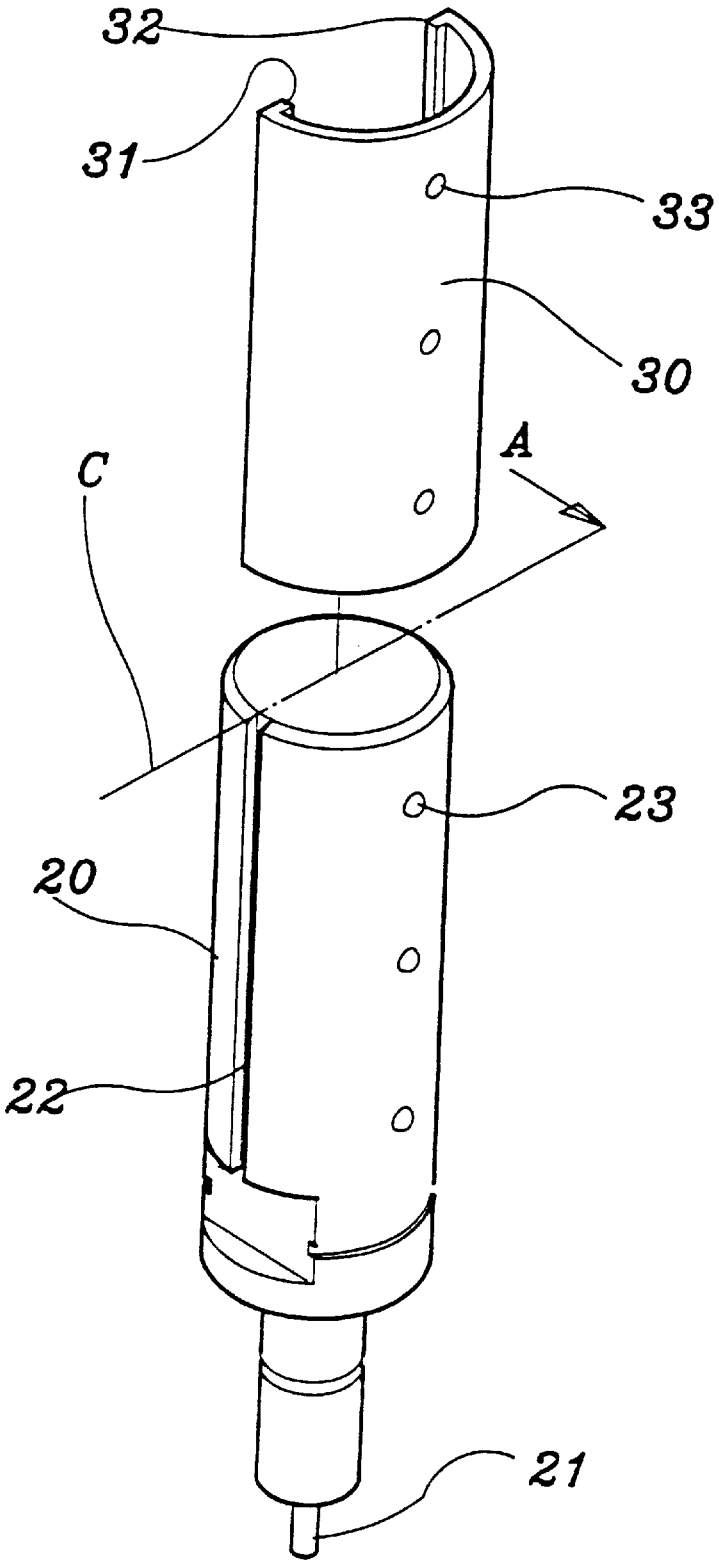
FIG. 3 is an exploded view of FIG. 2.

Referring to FIGS. 2 and 3, an antenna is shown comprised of a cylindrical core 20. The core 20 has a connector 21 at the bottom end for connection the circuit in the mainframe of the portable cellular telephone, and a winding assembly (not shown) on the inside connected to the connector for transmitting/receiving radio signal. When the user uses the portable cellular telephone, one side of the core 20 (see FIGS. 2 and 3, line C in direction A) faces the user's head. The side facing the user's head is shielded with a shield 30 to stop radiation of radio frequency energy from the core 20 in direction toward the user. The shield 30 preferably covers one half of the periphery of the core 20 in axial direction. The core 20 has two longitudinal locating grooves 22 at two sides, and a plurality of raised portions 23 arranged in a line between the longitudinal locating grooves 22. The shield 30 is made from a metal sheet, having a smoothly arched cross section, two inward coupling flanges 31;32 raised along two longitudinal sides thereof for engaging into the longitudinal grooves 22 on the core 20, and a longitudinal row of locating holes 33 on the middle for receiving the raised portions 23 of the core 20.

Figure 5:
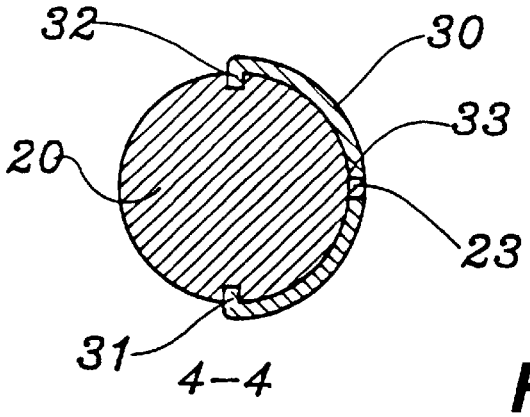
FIG. 5 is a cross sectional view taken along line 4—4 of FIG. 4.
Figure 4:
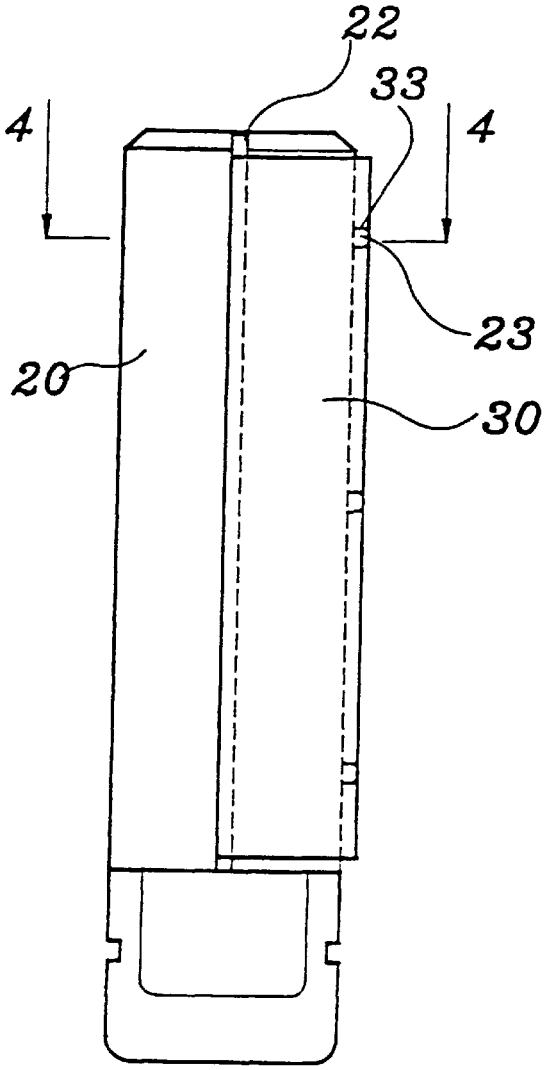
FIG. 4 is a front view of FIG. 2.

Referring to FIGS. 4 and 5, the shield 30 is resilient, and the two longitudinal sides of the shield 30 can be bent outwards for permitting the inward coupling flanges 31;32 to be moved with the shield 30 transversely over the periphery of the core 20 and then respectively forced into engagement with the longitudinal grooves 22 on the core 20. When the inward coupling flanges 31;32 of the shield 30 are respectively forced into engagement with the longitudinal grooves 22 on the core 20, the raised portions 23 of the core 20 are simultaneously forced into engagement with the locating holes 33 on the shield 30.

Figure 6:
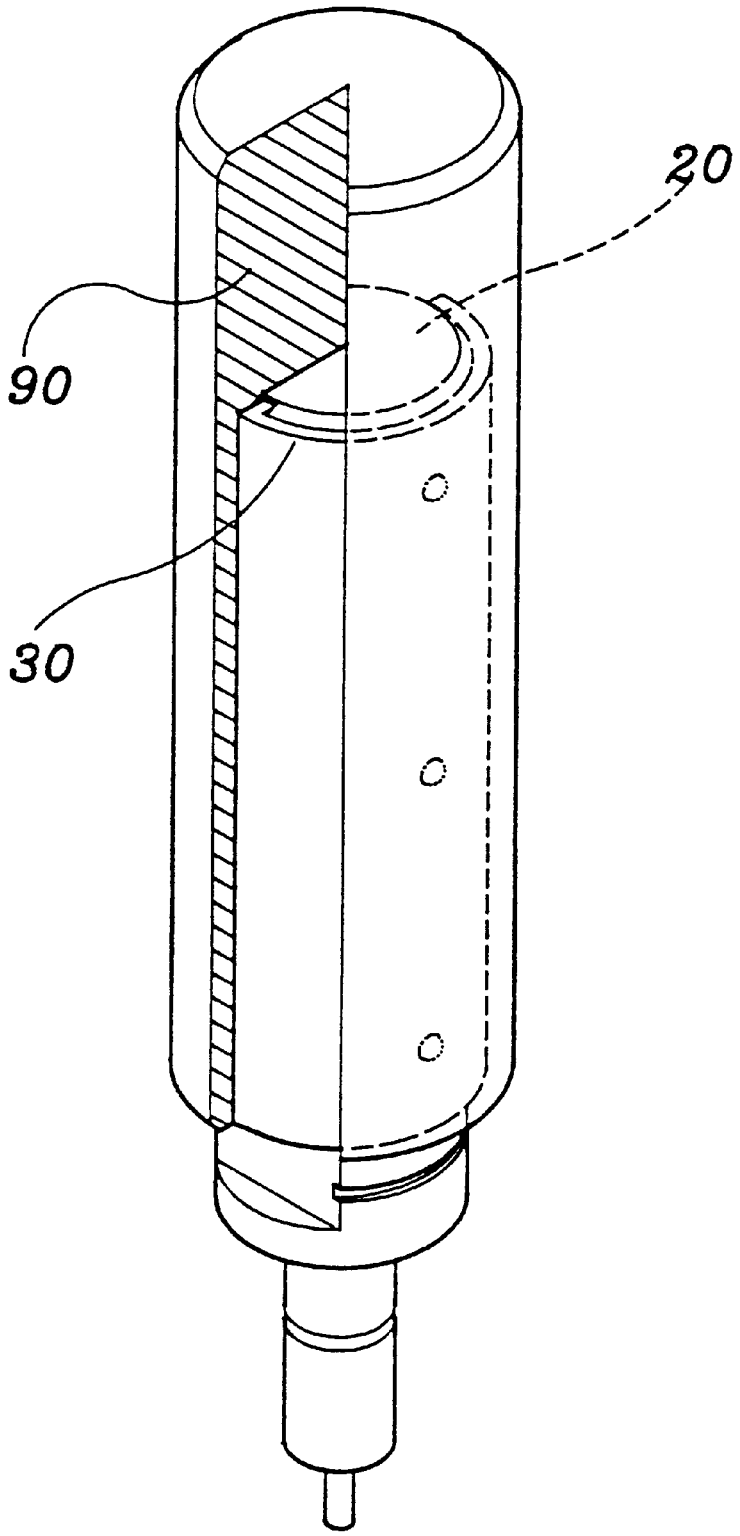
FIG. 6 shows the resin shell molded on the core and the metal shield according to the present invention.
Figure 7:
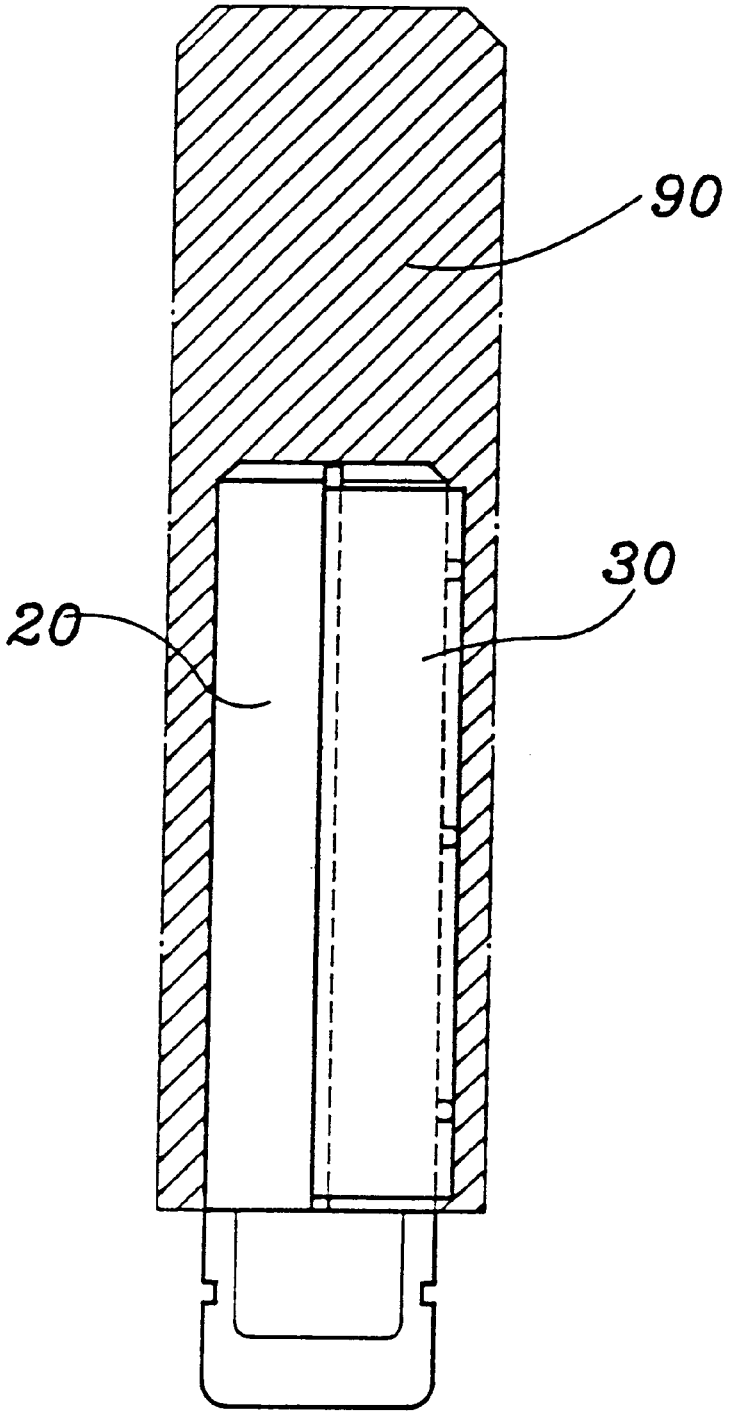
FIG. 7 is a longitudinal view in section of FIG. 6.

Referring to FIGS. 6 and 7, after the shield 30 and the core 20 have been fastened together, the assembly is put in a mold in an injection-molding machine (not shown), and then a resin shell 90 is molded on the core 20 and the shield 30.

Figure 8:
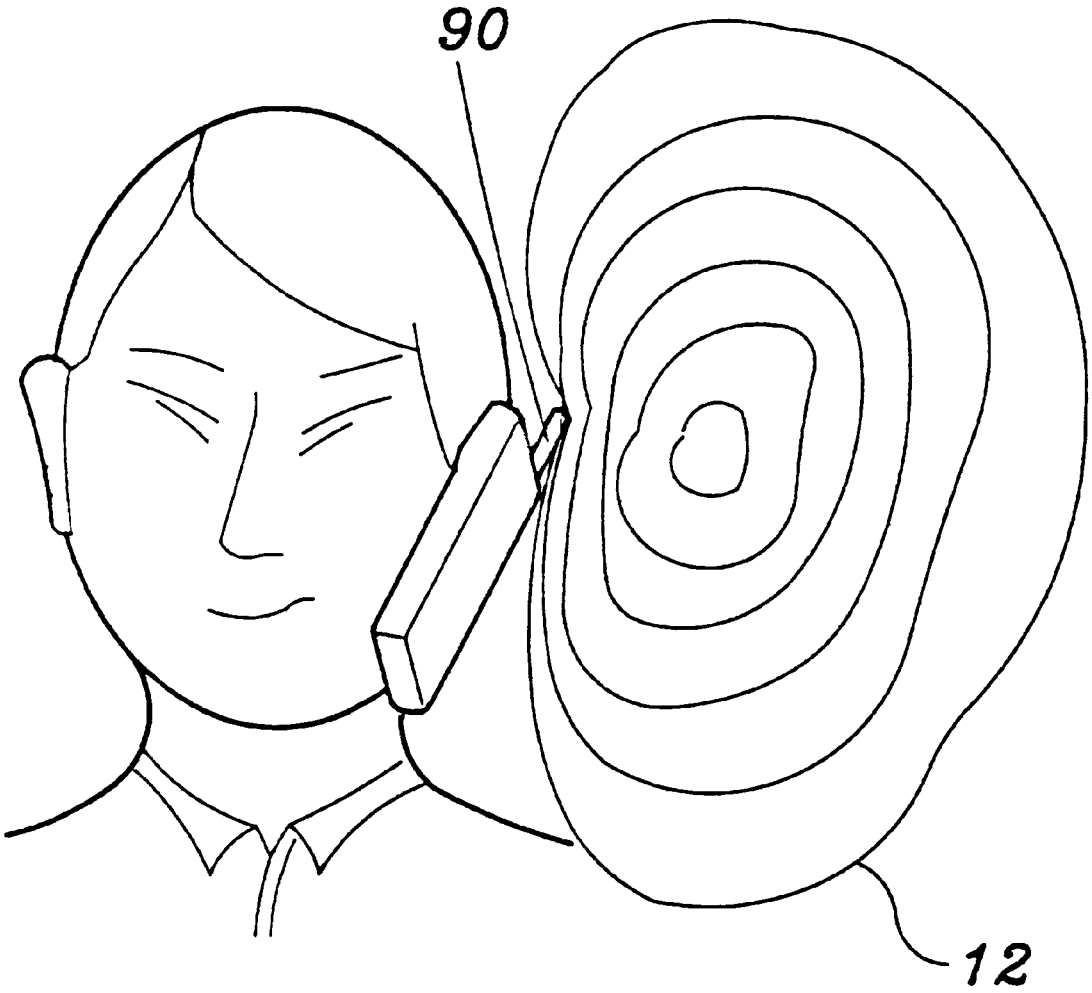
FIG. 8 is an applied view of the present invention, showing the radiation of radio frequency energy from the antenna in direction reversed to the user's head.

Referring to FIG. 8, when the user uses the portable cellular telephone, the radio frequency energy 12 which passes out of the resin shell 90 of the antenna is prohibited by the shield 30 from radiating in direction toward the user's head.

Figure 9:
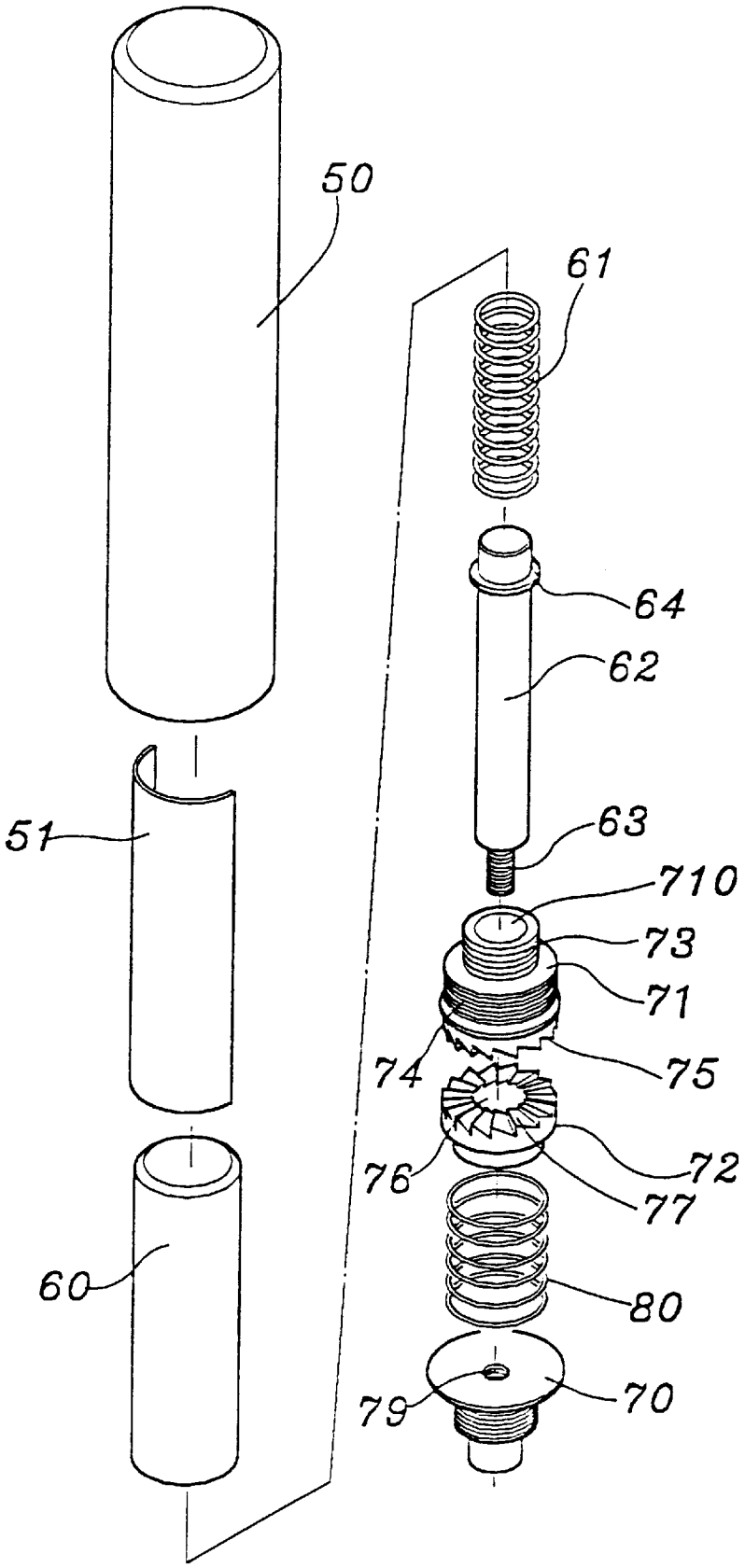
FIG. 9 is an exploded view of an antenna according to an alternate form of the present invention.

Figures from 9 to 12 show an antenna according to another embodiment of the present invention. As illustrated in FIG. 9, the antenna comprises a hollow, cylindrical, cap-like resin shell 50, a hollow, cylindrical, cap-like core 60 mounted within the resin shell 50, a shield 51 mounted on the outside wall of the core 60 within the resin shell 50, a center guide rod 62 longitudinally mounted within the core 60, the center guide rod 62 having a collar 64 around the periphery near its top end and a screw rod 63 downwardly extended from its bottom end, a winding 61 supported on the collar 64 of the center guide rod 62 within the core 60, a mounting member 70 having a top center screw hole 79 threaded onto the screw rod 63 of the center guide rod 62 for securing the antenna to the portable cellular telephone, an upper ratchet member 71 and a lower ratchet member 72 mounted around the center guide rod 62 between the collar

64 and the mounting member 70 and meshed together, and a compression spring 80 mounted around the center guide rod 62 and retained between the lower ratchet member 72 and the mounting member 70. The compression spring 80 imparts an upward pressure to the lower ratchet member 72, causing the lower ratchet member 72 to be forced into engagement with the upper ratchet member 71. The upper ratchet member 71 comprises a center through hole 710 which receives the center guide rod 62, a first outer thread 73 threaded into an inner thread 65 in the core 60, a second outer thread 74 threaded into an inner thread 52 in the resin shell 50, and a ratchet bottom face 75. The lower ratchet member 72 comprises a center through hole 76 which receives the center guide rod 62, and a ratchet top face 77 forced into engagement with the ratchet bottom face 75 of the upper ratchet member 71.

Referring to FIGS. 11 and 12 again, the mounting member 70 is fixedly mounted on the portable cellular telephone, and the screw rod 63 is threaded into the screw hole 79 on the mounting member 70. When installed, the antenna can be rotated on the mounting member 71 to change the position of the shield 51 shown in FIG. 11 to the position shown in FIG. 12. Because the upper ratchet member 71, the resin shell 50 and the core 60 are fastened together, rotating the resin shell 50 causes the core 60 and the upper ratchet member 71 to be synchronously rotated relative to the lower ratchet member 72. After adjustment, the lower ratchet member 72 is forced into engagement with the upper ratchet member 71 by the compression spring 80 again. Further, an index may be provided at the outside wall of the resin shell 50 for indication of the position of the shield 51. This alternate form of the present invention is designed for mounting on the portable cellular telephone by a screw joint.

It is to be understood that the drawings are designed for purposes of illustration only, and are not intended as a definition of the limits and scope of the invention disclosed.

What the invention claimed is:

1. An antenna for a portable cellular telephone comprising:

a core with a winding assembly, said core includes a longitudinal groove on each of two sides, and a resin shell molded on said core; wherein said core is covered with a shield means to limit the direction of radiation of radio frequency energy from said winding assembly, said shield means covers one half of the periphery of said core in a longitudinal direction, and said shield means has a longitudinal coupling flange along each of two longitudinal sides thereof, said flanges engage said longitudinal grooves on said core.

2. The antenna of claim 1 wherein:

said core has a plurality of longitudinally aligned raised portions, and said shield means has a plurality of longitudinally aligned locating holes which receive said raised portions of said core.

3. The antenna of claim 1 wherein:

said winding assembly comprises a center guide rod mounted within said core, said center guide rod having a collar around a periphery near a top end thereof and a screw rod extended downward from a bottom end thereof, a mounting member fixedly fastened to the portable cellular telephone, said mounting member having a top center screw hole into which said screw rod of said center guide rod is threaded, a winding supported on the collar of said center guide rod within said core, an upper ratchet member mounted around said center guide rod and fastened to said core and said resin shell, a lower ratchet member mounted around said center guide rod, and a spring means which urges said lower ratchet member into engagement with said upper ratchet member.

4. The antenna of claim 3 wherein:

said upper ratchet member has a first outer thread threaded into an inner thread in said core, and a second outer thread threaded into an inner thread in said resin shell.

5. The antenna of claim 3:

wherein said spring means is a compression spring mounted around said center guide rod and retained between said mounting member and said lower ratchet member.

* * * * *